US010295268B2

(12) United States Patent
Schryver et al.

(10) Patent No.: US 10,295,268 B2
(45) Date of Patent: May 21, 2019

(54) PHASE CHANGE THERMAL-SINK APPARATUS

(75) Inventors: Brian Schryver, Redwood City, CA (US); Scott Ganaja, San Luis Obispo, CA (US)

(73) Assignee: Cool Lab, LLC, Chelmsford, MA (US)

( * ) Notice: Subject to any disclaimer, the term of this patent is extended or adjusted under 35 U.S.C. 154(b) by 258 days.

(21) Appl. No.: 14/006,940

(22) PCT Filed: Mar. 23, 2012

(86) PCT No.: PCT/US2012/030236
§ 371 (c)(1),
(2), (4) Date: Sep. 23, 2013

(87) PCT Pub. No.: WO2012/129463
PCT Pub. Date: Sep. 27, 2012

(65) Prior Publication Data

US 2014/0008042 A1 Jan. 9, 2014

Related U.S. Application Data

(60) Provisional application No. 61/466,795, filed on Mar. 23, 2011.

(51) Int. Cl.

| | |
|---|---|
| ***F28F 7/00*** | (2006.01) |
| ***F25D 3/08*** | (2006.01) |
| ***F28D 15/00*** | (2006.01) |
| *A47G 23/06* | (2006.01) |
| *B65D 81/38* | (2006.01) |
| *B65D 81/18* | (2006.01) |

(52) U.S. Cl.
CPC ..... *F28D 15/00* (2013.01); *F25D 3/08* (2013.01); *A47G 23/0683* (2013.01); *A47G 2023/0691* (2013.01); *B65D 81/18* (2013.01); *B65D 81/38* (2013.01); *F25D 2303/082* (2013.01); *F25D 2303/0831* (2013.01); *F25D 2303/0845* (2013.01)

(58) Field of Classification Search
CPC ..... F25D 3/06; F25D 3/08; F25D 2303/0845; F25D 2303/082; A47G 2023/0691; A47G 23/0683; B65D 81/18; B65D 81/38
USPC ..... 62/371, 372, 457.1
See application file for complete search history.

(56) References Cited

U.S. PATENT DOCUMENTS 3,922,879 A * 12/1975 Arnold ..... F25D 3/00 433/77
4,924,935 A * 5/1990 Van Winckel ..... F28D 20/02 165/10
5,361,604 A * 11/1994 Pier ..... B65D 81/3883 62/371
5,415,282 A * 5/1995 Kienholz ..... A01N 1/02 206/216
5,689,970 A * 11/1997 Chopas ..... B01L 7/00 62/372
6,044,650 A * 4/2000 Cook ..... A61J 1/165 62/130

(Continued)

*Primary Examiner* — Paul Alvare
(74) *Attorney, Agent, or Firm* — Kirton & McConkie; David R. Conklin

(57) ABSTRACT

Cartridges for maintaining objects at a desired temperature for extended periods of time can be constructed by sealing a thermoconductive cover on a flexible base container filled with a phase change material with a phase change temperature identical to the desired temperature.

18 Claims, 8 Drawing Sheets

(56) References Cited

U.S. PATENT DOCUMENTS

| | | | | |
|---|---|---|---|---|
| 7,051,730 | B2 * | 5/2006 | Lin | A47J 41/0044 126/246 |
| 8,258,439 | B2 * | 9/2012 | Mak | F25D 3/08 219/387 |
| 2007/0012066 | A1 * | 1/2007 | Kaplan | F25D 3/08 62/457.2 |
| 2010/0147014 | A1 * | 6/2010 | Kim | A47G 19/027 62/457.6 |
| 2011/0082437 | A1 * | 4/2011 | Stacey | F25D 15/00 604/404 |
| 2011/0220633 | A1 * | 9/2011 | Mak | F25D 3/08 219/482 |
| 2011/0259894 | A1 * | 10/2011 | Cheung | A45C 11/20 220/592.01 |

* cited by examiner

PHASE CHANGE THERMAL-SINK APPARATUS

This application is a National Stage of International Application No. PCT/US2012/030236, filed Mar. 23, 2012, and entitled PHASE CHANGE THERMAL-SINK APPARATUS, which claims the benefit of U.S. Provisional Application No. 61/466,795, filed Mar. 23, 2011, and entitled PHASE CHANGE THERMAL-SINK APPARATUS. This application claims priority to and incorporates herein by reference the above-referenced applications in their entirety.

FIELD OF THE INVENTION

This invention relates to devices that provide a passive thermal sink to maintain temperature within a close range while absorbing thermal energy from objects in direct contact, in close proximity, or connected by thermoconductive materials, with the device. In particular, the device is useful for cooling temperature-sensitive materials and devices and/or maintaining them at a cool temperature.

BACKGROUND OF THE INVENTION

The latent heat absorption property of material phase change has been used as a means for absorbing heat influx and maintaining the temperature of objects in close contact or local proximity within a desired range. The phase change of water, due to the relatively large latent heat of fusion of the material, provides an excellent means of maintaining temperatures near 0° Celsius. As the presence of liquid water produced by the phase change can be inappropriate for many applications, enclosing both the solid and liquid phase in a sealed container provides a simple means of preventing water damage. To enhance container security, the container may be constructed from robust materials; however, due to the approximate ten percent volume expansion of water upon solidification, containers need to be constructed from flexible materials that do not rupture or fracture under the high expansion pressure.

Materials such as plastics and rubbers are used to construct such expandable containers. To reduce the container thickness while managing the risk of a rupture spill, water is often absorbed into materials such as gels, foams, and fibers, and enclosed in sealed bags or containers. Such options are frequently applied where costs and weight reduction is desired, as in shipping and transport applications.

Unfortunately, however, such containment options are also typically associated with insulating properties that restrict the flow of thermal energy to the phase change medium. Plastic and rubber container materials have a low thermal conductivity and effectively insulate the phase change material contained therein. Absorptive materials also present an insulating feature in that the materials will thaw from the outside inward as heat is absorbed. The thawed material restricts the transfer of thermal energy to the solid remaining core, thereby imposing an increasingly thicker insulation barrier as the phase change progresses. Placing an insulation barrier between the solid phase of the phase change material and the object that is to be thermally regulated increases the dynamic effective temperature of the material or device. As the effective insulation barrier thickens, the temperature of the object will rise and may exceed the desired temperature range.

While a variety of devices and materials require cooling or maintenance at a cool (below ambient room temperature, i.e., around 0° Celsius), biological materials (organs, tissues, cells, cellular components, proteins, nucleic acids, and the like) are frequently maintained at cool temperatures, because the natural breakdown of biological materials can be significantly delayed by refrigeration. While many types of biological specimens can be preserved for an even greater duration by freezing the material, freezing is inappropriate for many biological samples. Tissue structures can be disrupted by ice crystal formation, thereby desegregating labile and degradative components. For example, specimen solutions can be damaged by ice crystal formation, as well, and concentrated solutes may impose conditions of pH and salt tonicity that alter molecular structures. As a result it is desirable to maintain biological specimens at a temperature that is above 0° Celsius and below 4° Celsius. Although this temperature range can be easily achieved by placing specimens into crushed ice or into ice water, safety, energy management, ergonomic, clinical protocol, space restriction, and sterility concerns have created a significant need for portable cooling solutions without exposed ice. Aqueous gels, contained water, and absorbed water-based phase change solutions currently fulfill the need for thermal sinks on which portable passive cooling solutions can operate. However, due to the construction of the thermal sink units, a steady temperature near the phase-change temperature of the thermal sink medium is difficult to maintain.

Numerous substances with temperature sensitivities, including biological samples, chemicals, and drugs are subject to degradation when shipped by common methods using gel packs and insulated containers. Unless the payload of the package is in intimate contact with the phase change medium, thermal gradients inside the package can result in significant elevations in temperature in addition to temperature fluctuations as package contents rearrange during shipment. As the gel packs thaw during normal use, the added thawed material on the gel pack boundary adds more separation from the frozen core, further increasing the temperature differential thereby.

Therefore, there is a need for a phase-change container that will isolate the phase change material, allow for expansion upon solidification of the contained material, provide a thermally conductive interface with the object to be thermally regulated, and ensure close proximity of the solid phase of the phase change material to the thermally conductive barrier, thereby cooling an object and/or maintaining the cooled object in a narrow temperature range close to phase change media transition temperature. The present invention meets these needs.

SUMMARY OF THE INVENTION

The present invention provides methods and devices for cooling and maintaining a temperature of an object. In particular, the present invention relates to a thermal sink cooling cartridge which includes an expandable base container having a thin, thermoconductive cover, wherein an aqueous medium is stored in the base container and in contact with the thermoconductive cover. The expandable base container generally comprises a non-porous material that is durable at low temperatures. In some instances, the expandable base container may include a polymer material that remains flexible or pliable at low temperatures, such as polyethylene, polypropylene, Santoprene™, Titan™, Engage™, ethylene vinyl acetate, PETG, silicone, and other weatherable polymer materials. The expandable base container may further include one or more plasticizers to improve the flexibility and durability of the container.

In various embodiments, the cartridge module of the invention comprises a base container which accommodates an expanding volume of the aqueous medium upon solidification without rupture, failure of container seams, or significant distortion of overall dimensions of the base container. For example, in some implementations the expandable base container comprises at least one expansion panel, whereby the interior volume of the base container may expand in response to increased pressure within the container. The expansion panel may include a fold, a crimp, a recessed surface, or other integrated shape or contour which allows for expansion of the aqueous medium within the expandable base container.

In various embodiments, the cooling cartridge of the invention comprises a thermoconductive cartridge cover that provides a thermally conductive interface. In general, the aqueous medium is positioned within the base container such that contact remains constant between the thermoconductive cover and the aqueous medium throughout various phase changes of the aqueous medium. Thus, in some implementations the expandable base container is completely or almost completely filled with the aqueous medium such that there are no, or only minimal, air pockets between the aqueous medium and the thermoconductive cover. As used herein, minimal air pockets means that less than 20% of the upper plate surface area is in contact with air pocket (s), including less than 10%, less than 5%, less than 3%, and less than 1%.

As the aqueous medium changes from liquid to solid, the solid phase of the aqueous medium becomes buoyant within the base container and forms an interface directly with the thermoconductive cover. Heat from the solid phase of the aqueous medium is therefore transferred to the thermoconductive cover throughout the duration of the medium's solid phase. The buoyant nature of the solid phase ensures constant contact between the solid phase and the thermoconductive cover as the aqueous medium changes from solid to liquid phase. Thus, heat transfer between the solid phase of the aqueous medium and the thermoconductive cover is maximized by various implementations of the present invention.

In some aspects of the invention, the expandable base container comprises flared or tapered side walls to encourage separation between the base container and the solid phase of the aqueous medium. As the aqueous medium becomes solid and therefore buoyant within the base container, the flared or tapered sides walls reduce any compressive or shear forces between the solid phase the side walls. As such, the solid phase aqueous medium is released from the side walls and permitted to rise within the base container to contact the thermoconductive cover.

In some implementations, an external object is cooled by placing the object in direct contact with the thermoconductive cover. Heat from the aqueous medium is transferred to the object via the thermoconductive cover. Thus, in some aspects of the invention the thermoconductive cover comprises a thermoconductive material, such as aluminum, copper, silver, gold, an aluminum alloy, a copper alloy, a silver alloy, a gold alloy, a titanium alloy, stainless steel, and/or a magnesium alloy.

In some implementations, the thermoconductive cover further comprises one or more magnets whereby to facilitate coupling of the thermoconductive cover to an external object. In some instances, the one or more magnets are imbedded within the material of the thermoconductive cover. In other implementations, the one or more magnets are attached to any surface of the thermoconductive cover, wherein the one or more magnets magnetize the remaining surfaces of the thermoconductive cover.

In some implementations, the thermoconductive cover further comprises a temperature sensor and indicator coupled to a portion of the thermoconductive cover. The temperature sensor and indicator may monitor and display the temperature of the thermoconductive cover. In some implementations, the temperature sensor and indicator comprises a temperature sensitive strip that is applied to the thermoconductive cover via an adhesive.

In some instances, the thermal sink cooling cartridge further includes a fluid tight seal interposed between an opening of the expandable base container and the thermoconductive cover. The fluid tight seal prevents leakage of the aqueous medium within the base container. The fluid tight seal further prevents leakage of the aqueous medium due to increased pressure within the base container. Accordingly, in some implementations of the present invention a fluid tight seal includes at least one of an adhesive, a silicone-based adhesive, a compressed gasket, an o-ring, a compression band, a clamp, a crimped seal, and a fusion weld. Further, in some instances a fluid tight seal includes a rim channel molded into a base portion of the expandable base container.

The thermal sink cooling cartridge of the present invention may further include various features and surfaces to facilitate handling of the device. For example, the expandable base container may include a contact surface having a feature, a texture, a contour, and/or a shape to assist a user in handling and transporting the cartridge device. The cartridge may further include at least one of a ridge, a groove, a peg, a hole, a texture, a feature, a protrusion, an encasement and/or an indent to accommodate or receive an external object.

An external object may include any object for which cooling is desired. An external object may further include any object capable of transferring heat to the thermoconductive cover, the expandable base container, or the aqueous medium of the cartridge device. Non-limiting examples of external objects may include a biological sample, an organic material, an inorganic material, a food, dry ice, an electronic component, an automated machine, a stand, a refrigeration device, a computer chip, a sample tray, a sample tube, a container, an adapter for a container, and a sample rack.

In some implementations, the thermal sink cooling cartridge is connected to an external object via a thermoconductive channel. For example, in some aspects the cooling cartridge is connected to an external object via a heat tube. The cooling cartridge may further be connected to an external object via a heat sink, a conduit, a refrigeration line, and a water bath.

The thermal sink cooling cartridge of the present invention may further include various features and surfaces to accept or compatibly receive an external storage housing. For example, an external surface of the cooling cartridge may include a feature, a texture, a contour, and/or a shape which engages or interlocks with a feature, texture, contour, and/or shape of an interior surface of a storage housing. A storage housing may include a container comprising an insulating material, such as polyethylene foam, polypropylene foam, styrene foam, urethane foam, and evacuated containers. In some implementations, the storage housing comprising a shipping container.

In some instances, an aqueous medium comprises purified water. In various embodiments, the liquid phase change medium is water, water admixed with a dye (to facilitate identification of ruptures or leaks), or water admixed with another substance that changes the freezing point of the aqueous medium. For example, in some instances the aqueous medium comprises water containing an additive selected from glycerol, a salt, polyethylene glycol, an alcohol, a simple sugar, a complex sugar, and a starch. The aqueous medium may further include an antimicrobial material to prevent growth or colonization of microbes within the aqueous medium. Accordingly, some implementations of the invention further include one or more ports that can be used to access an interior of the expandable base container, wherein the one or more ports is used to add, modify, or replace the aqueous medium or an additive of the aqueous medium.

The aqueous medium is placed in the expandable base container such that a portion of the aqueous medium is in contact with the thermoconductive cover. Thus, heat from the aqueous medium is transferred to an external object via the thermoconductive cover. Accordingly, in some instances, the aqueous medium is separated from the external object only by a thin thermoconductive barrier or cover which greatly improves temperature stability and control for the external object while providing a temperature approximate to 0 degrees Celsius. Some implementations further provide cooling of an external object while avoiding the danger of freezing.

In some implementations, the present invention provides a passive thermal sink cooling cartridge, consisting of an expandable base container filled with an aqueous medium and having a cover that provides a thermally conductive interface, with said cover attached to the top of the sides of the container by a fluid tight seal that prevents leakage of the aqueous medium, which cartridge can sustain an influx of thermal energy while providing a conductive interface temperature that remains constant over the duration of a phase transition of the aqueous medium contained therein (i.e. from a solid to a liquid). Some aspects of the invention further include a compressible element in contact with the aqueous medium. The compressible element comprises a volume which may be reduced in response to external pressures exerted by the aqueous medium during change of the medium from a liquid to a solid phase. For example, the compressible element may include a closed cell, foam material.

The cartridges of the invention can be of any size and can be used in any application where one desires to maintain an object (and its contents) at a temperature that is the temperature at which the aqueous medium undergoes a phase change. For example, and without limitation, if one desires to maintain a biological sample at a temperature in the range of 0° Celsius to 4° Celsius, then the cartridges of the invention that contain water as the liquid phase change medium are ideal. Depending on the size of the biological sample (and any container in which it may be located), one selects an appropriately sized cartridge of the invention containing an aqueous phase change medium, subjects the cartridge to conditions that convert some or all of the aqueous phase change medium into ice, and then places the biological sample (or its container) onto the cover of the cartridge. The ice in the cartridge, due to its buoyancy in water, will remain in direct contact with the thermoconductive cover until it completely melts, thus providing optimal temperature maintenance results.

Thus, in a second aspect, the present invention provides methods for maintaining an object at a desired temperature, said methods comprising placing said objects on the thermoconductive cover surface of a device of the invention.

These and other aspects, embodiments, and advantages of the invention are described in the attached drawings and following detailed description.

DETAILED DESCRIPTION OF THE INVENTION

The present invention provides a passive cooling cartridge or thermal sink that can be used to regulate the temperature of objects placed in contact with the cover of or otherwise in close proximity to the cartridge. The cartridge comprises a flexible base container that contains an aqueous medium. The cover of the container is constructed from any thermally conductive material, often a material with a thermal conductivity in the range of 12 to 430 Watts per meter per degree Kelvin, and directly contacts the solid phase of the phase change material (on the side facing the cartridge interior) and forms a thermally conductive junction with external objects placed on it (the side facing away from the cartridge interior) for the purpose of cooling those objects and/or maintaining them at the phase change temperature.

In some embodiments, the base container is constructed from a semi-flexible plastic or rubber material so that the container does not fracture or rupture, or the thermally conductive surface become distorted when an aqueous or other phase change material that expands upon solidification solidifies. In some embodiments the base container will have molded features that will allow for the expansion of the phase change material upon solidification. Such features include, but are not limited to, invertible recesses, relief cavities, expandable bellows, stress relief ridges, and/or compressible cavities. In other embodiments, the base container comprises an under ridge or protrusions for the purpose of supporting the cartridge on a surface while minimizing direct contact of the container base with the supporting materials. Other embodiments include ridges or projections that allow cartridges to be securely stacked while restricting lateral slippage. As the intended operation of the cartridge depends upon direct contact of the solid phase with the thermoconductive surface, in some embodiments the base container will have a taper to the side walls which will facilitate the separation of the solid phase from the walls shortly after conversion of the solid phase to liquid phase at the solid phase/container interface is initiated. This feature will allow the solid phase to be buoyant for materials for which the solid phase is less dense than the liquid phase (for example, water).

Figure 1:
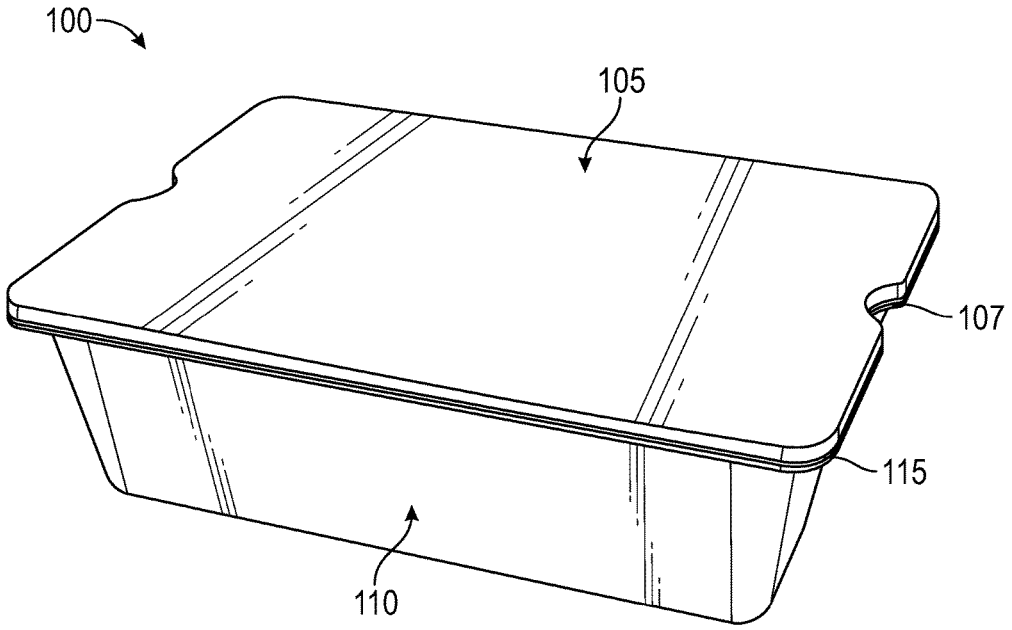
FIG. 1 shows a perspective view of a thermal sink cooling cartridge in accordance with a representative embodiment of the present invention.

Referring now to FIG. 1, a representative embodiment of a thermal sink cooling cartridge 100 is shown. In some embodiments, the cartridges comprise a thermoconductive upper cover 105 that is affixed to the lower base container to form a sealed cavity that contains the phase change medium. In other embodiments, the thermoconductive cover 105 has a flat surface upon which objects to be cooled may interface with the cartridge. In some embodiments, a cartridge is provided having dimension of approximately 9 inches in length, 7.5 inches in width, and 2.5 inches in height. The expandable base 110 may be constructed from low density polyethylene material which is vacuum molded into the configuration shown. Expandable base 110 is further bonded to thermoconductive cover 105 via a sealant 115, such as an adhesive, thereby providing a fluid tight seal between cover 105 and base 110. In some embodiments, thermoconductive cover 105 is sealed to base 110 via a Loctite RTV silicone, item #37460, manufactured by Loctite. In some aspects of the invention, base 110 and/or cover 105 are treated with oxygen prior to applying an adhesive sealant 115. For example, in some embodiments base 110 and/or cover 105 are heated with an oxygen-rich flame prior to applying sealant 115.

Sealant 115 interposed between an opening of the expandable base container 110 and the thermoconductive cover 105 provides a fluid tight seal. Thus, sealant prevents leakage of the aqueous medium 225 (FIG. 2) within the base container. The fluid tight seal further prevents leakage of the aqueous medium due to increased pressure within the base container. Accordingly, in some implementations of the present invention a fluid tight seal includes at least one of an adhesive, a silicone-based adhesive, a compressed gasket, an o-ring, a compression band, a clamp, a crimped seal, and a fusion weld. Further, in some instances a fluid tight seal includes a rim channel molded into a base portion of the expandable base container.

In some embodiments, thermoconductive cover comprises a thermoconductive material, such as aluminum, copper, silver, gold, an aluminum alloy, a copper alloy, a silver alloy, a gold alloy, a titanium alloy, stainless steel, and/or a magnesium alloy. Cover 105 may further be constructed from an aluminum alloy sheet that has been type 2 anodized for corrosion resistance. In some embodiments cover 105 comprises a 0.20 inch thick aluminum alloy material, such as a 6000 series aluminum alloy. In particular, in some embodiments cover 105 comprises T-6061 aluminum alloy.

With continued reference to FIG. 1, expandable base container 110 generally comprises a non-porous material that is durable at low temperatures. In some instances, the expandable base container may include a polymer material that remains flexible or pliable at low temperatures, such as polyethylene, polypropylene, Santoprene™, Titan™, Engage™, ethylene vinyl acetate, and other weatherable polymer materials. The expandable base container may further include one or more plasticizers to improve the flexibility and durability of the container.

Figure 2:
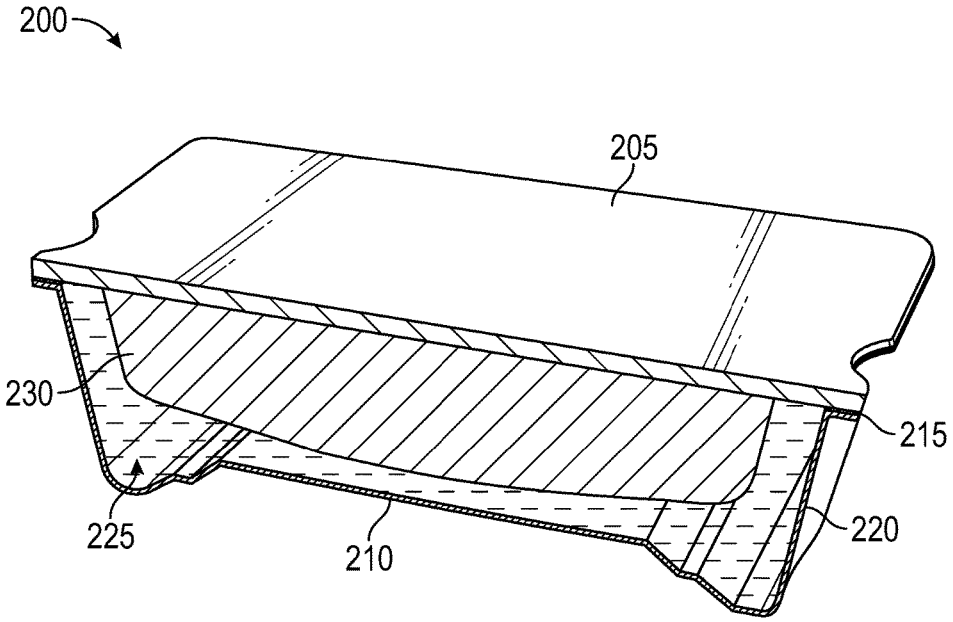
FIG. 2 shows a cross section view of a thermal sink cooling cartridge in accordance with a representative embodiment of the present invention.

In some embodiments, base container 110 accommodates an expanding volume of the aqueous medium, upon solidification, without rupture, failure of container seams, or significant distortion of overall dimensions of the base container. For example, in some implementations the expandable base container comprises at least one expansion panel 210, whereby the interior volume of the base container may expand in response to increased pressure within the container, as shown in FIG. 2. The expansion panel may include a fold, a crimp, a recessed surface, or other integrated shape or contour which allows for expansion of the aqueous medium within the expandable base container.

With continued reference to FIG. 2, expandable base container 220 comprises a molded recess which forms expansion panel 210. Expansion panel 210 allows for the expansion the aqueous medium 225 during phase transition to solid 230, while preventing a protrusion of the base that could interfere with cartridge stability. The solid phase 230, being less dense than the liquid phase of aqueous medium 225, is buoyant and thereby remains in direct contact with thermoconductive cover 205. As such, the temperature of thermoconductive cover 205 is maintained at a temperature close to the temperature of solid phase 230. Where aqueous medium 225 is water, the temperature of conductive cover 205 is approximately 0° Celsius. In some embodiments, sealant 215 may correspond to the sealant 115 of FIG. 1.

In some embodiments, the undersurface of the thermoconductive cover 205 is laminated with a thin layer of plastic to enhance corrosion resistance. In some embodiments, the thermoconductive cover 205 further comprises one or more magnets whereby to facilitate coupling of the thermoconductive cover to an external object. In some instances, the one or more magnets are imbedded within the material of the thermoconductive cover 205. In other implementations, the one or more magnets are attached to any surface of the thermoconductive cover 205, wherein the one or more magnets magnetize the remaining surfaces of the thermoconductive cover.

Figure 3:
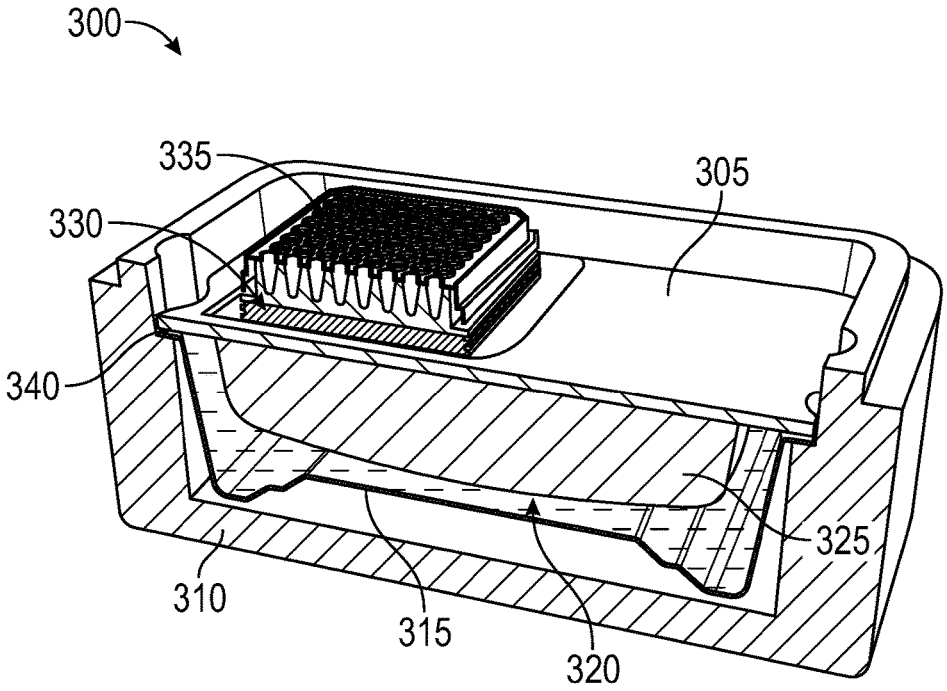
FIG. 3 shows a cross section view of a thermal sink cooling cartridge within a storage housing in accordance with a representative embodiment of the present invention.

Referring now to FIG. 3, a representative embodiment 300 of the cartridge is shown as it would be typically applied for maintaining biological samples between 0° Celsius and 4° Celsius in a portable insulated cooling device (such as the CoolBox™ device marketed by BioCision, LLC). Multiple liquid biological samples are contained within the wells of a 96 well plastic sample microplate 335. The microplate rests upon a thermoconductive adaptor 330 that rests upon thermoconductive cover 305 of the cartridge. The upper plate is bonded to the plastic container 315 by a sealant 340. The container is filled with water, or another suitable aqueous medium, shown in both liquid phase 320 and solid phase 325. The buoyant solid phase 325 is held in direct contact with the thermoconductive cover 305, thereby conducting thermal energy from the solid phase 325 to the biological samples, microplate 335, and adaptor plate 330.

Figure 4:
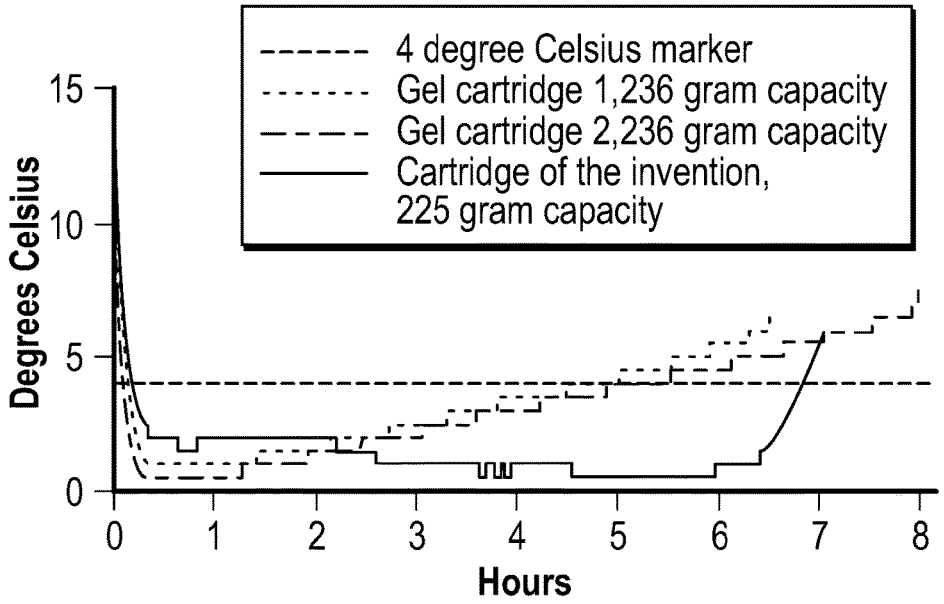
FIG. 4 shows a graph demonstrating the effectiveness of various representative embodiments of the present invention.

In some embodiments, influx of lateral and root surface environmental heat into the cartridge assembly is limited by containing the cartridge in an insulating box 310. Insulating box 310 may be constructed from high density polyethylene foam. As shown in FIG. 4, the assembly 300 has a distinct performance advantage over an identical assembly wherein the cartridge of the invention is substituted with an aqueous gel cartridge of comparable mass.

Referring now to FIG. 4, a graph of the temperature over time of samples stored or held in various cooling cartridges of the present invention is shown. Details regarding the results of the graph shown in this Figure are discussed below, as part of Example 1.

Figure 5:
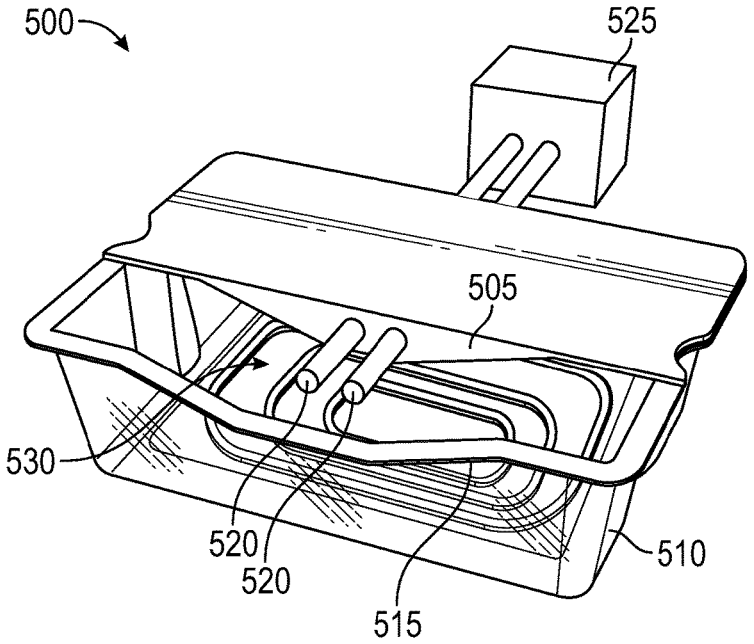
FIG. 5 shows a partial cross section view of a thermal sink cooling cartridge coupled to an external object via a thermoconductive channel in accordance with a representative embodiment of the present invention.

Referring now to FIG. 5, a representative embodiment 500 of a cartridge of the invention in partial cross-section, wherein the cooling and re-freezing function of the cartridge can be coupled to remote devices. In this embodiment, the thermoconductive cover comprises a central region of increased thickness 505 wherein single or multiple channels of thermoconductive material such as copper or heat tubes 520 can be embedded. The thermoconductive channels may interface with an external body 525 which may comprise, but is not limited to, refrigeration units, Peltier coolers, heat sinks, thermoconductive adaptors and plates, heat exchangers, micro chips, medical devices, and temperature sensors. As in the embodiments shown in FIGS. 1 and 2, the upper plate 505 is bonded to the lower container 510 through an adhesive or sealant layer 515 to form a sealed container enclosing the phase change material in the inner cavity 530.

Some embodiments of the present invention further comprise a non-aqueous medium. For example, a thermal sink cooling cartridge of the present invention may include organic compounds which are capable of transferring heat to a thermoconductive cover of the present invention. The cartridge may further include ammonia or one or more waxes. For substances that have a solid phase that is more dense than the liquid phase, the cartridge can be, for example and without limitation, inverted for the purpose of operation. In such embodiments, a thermal interface with external objects may be accomplished by, but not limited to, the interface shown in FIG. 5.

Figure 6:
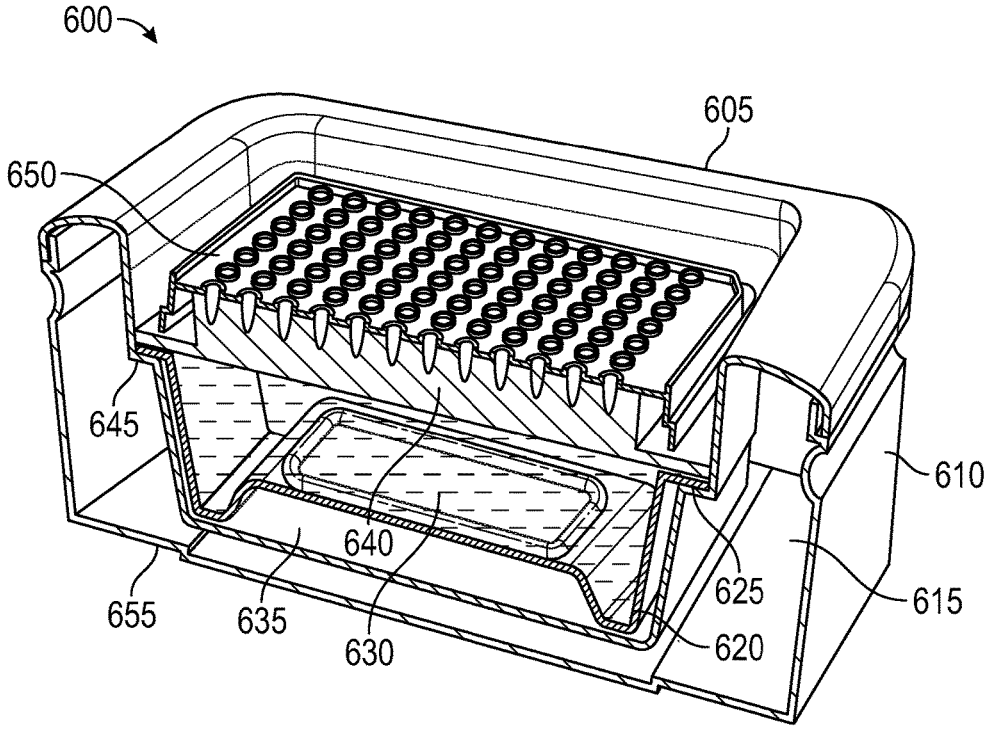
FIG. 6 shows a cross section view of a thermal sink cooling cartridge within a storage housing in accordance with a representative embodiment of the present invention.

FIG. 6 shows a representative embodiment of the invention 600 in which the upper thermoconductive cover or plate 640 comprises an integral multiplicity of recesses for the purpose of interfacing with a plastic microplate sample container 650. Accordingly, a dedicated cooling cartridge for a particular microplate format may be provided.

Some embodiments of the present invention comprise various features and surfaces to accept or compatibly receive an external object. For example, the cooling cartridge may include a feature, a texture, a contour, and/or a shape which engages or interlocks with a feature, texture, contour, and/or shape of an external object. The cartridge may further include at least one of a ridge, a groove, a peg, a hole, a texture, a feature, a protrusion, an encasement and/or an indent to accommodate or receive an external object.

The upper plate 640 is bonded to the plastic container 620 by an adhesive layer 645. The container undersurface comprises an inner recess that has molded bellows 630 for the purpose of allowing expansion of the cartridge contents. The cartridge is contained within a plastic shell housing 605 and 610 wherein it rests upon a molded shelf 625. The interior of the shell housing 615 can be filled with an insulating material such as, but not limited to, styrene or polyurethane foams. An adaptor feature 655 for the purpose of positioning upon or within external devices such as, but not limited to, robotic platens, shaker tables, or storage shelves, is shown.

Figure 7:
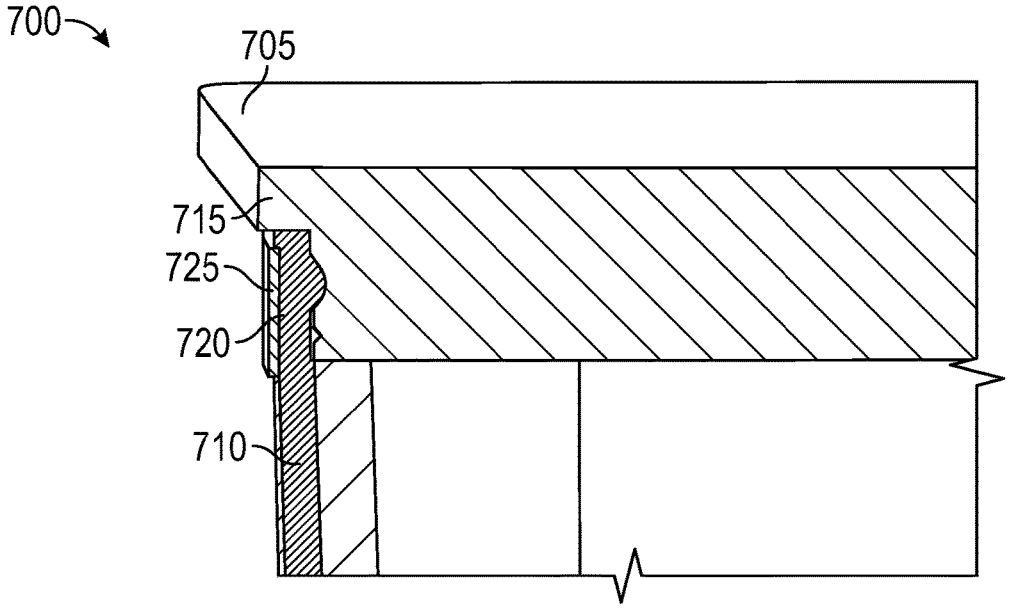
FIG. 7 shows a detailed, cross section view of an interface between a thermal sink cooling cartridge expandable base container and a thermally conductive cover in accordance with a representative embodiment of the present invention.

Referring now to FIG. 7, a cartridge of the invention is shown wherein the upper thermoconductive cover 705 forms an interface with the expandable base container 710 through a pedestal extension 715. The pedestal extension 715 comprises a groove that receives a molded bead extension of the container rim 720. The interface is sealed by pressure from a band 725 that surrounds the cartridge at this position. Thus, thermoconductive cover 705 is coupled to base container 710 through a mechanical connection.

Figure 8:
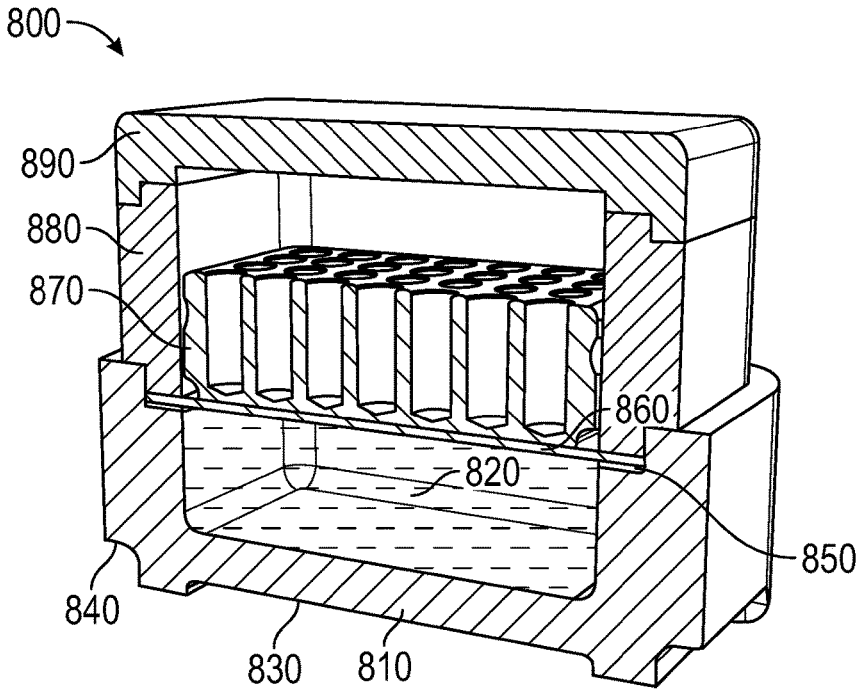
FIG. 8 shows a cross section view of a thermal sink cooling cartridge within a storage housing in accordance with a representative embodiment of the present invention.

With reference to FIG. 8, a cartridge is shown wherein the insulating container 810 comprises a nonporous insulating, material such as high density closed-cell polyethylene foam. The container is bonded directly to the thermally conductive plate 860 through an adhesive layer or sealant 850. A recessed cavity 830 on the underside of the container provides an area for the foam container to expand as the aqueous contents in the container cavity 820 expand upon solidification. The container and thermally conductive plate is shown supporting a thermally conductive sample tube holder 870. A collar of insulating material 880 may interface with the foam of the container to insulate the thermally conductive rack from the environment. An insulating lid 890 is shown in place for additional thermal isolation of the sample tube holder. Two inset cavities 840 on either side of the container provide a convenient means of lifting and support during transport.

Figure 9:
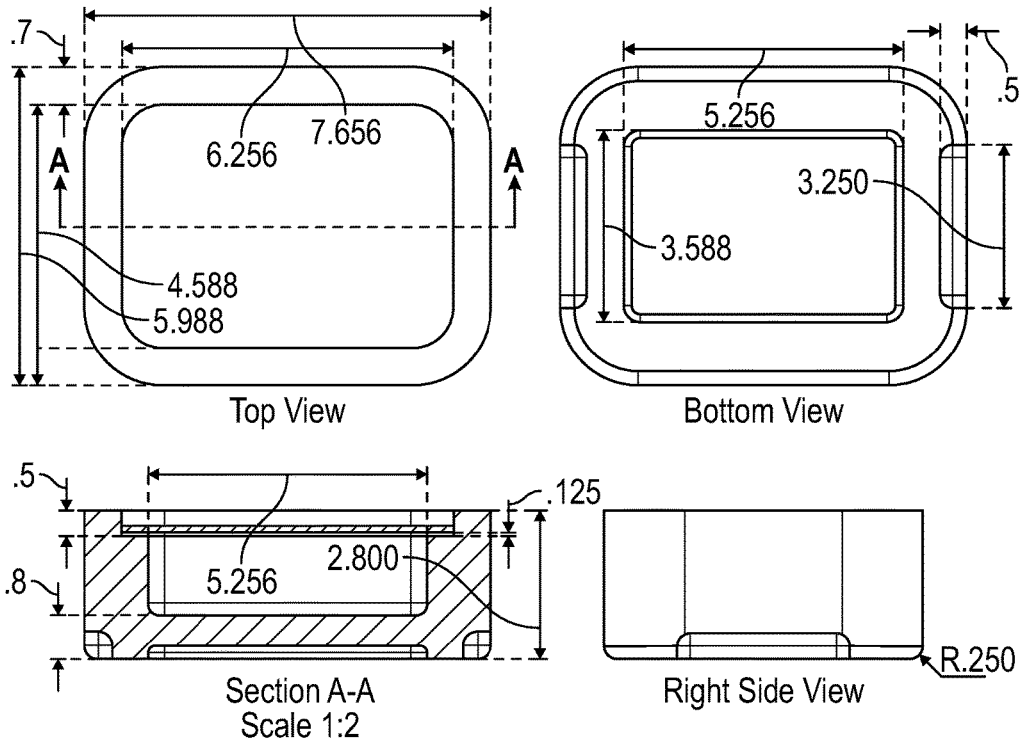
FIG. 9 shows the dimensions of the thermal sink cooling cartridge container shown in FIG. 8.

Referring now to FIG. 9, the dimensions of the container shown in FIG. 8 are provided. In some embodiments, the foam container has an overall length of approximately 7.6 inches and a width of approximately 6 inches and a height of 2.8 inches. Further, in some embodiments the thermally conductive plate (FIG. 8, item 860) has dimensions of approximately 6.3 inches in length, 4.6 inches in width, and 0.125 inches in thickness.

Figure 10:
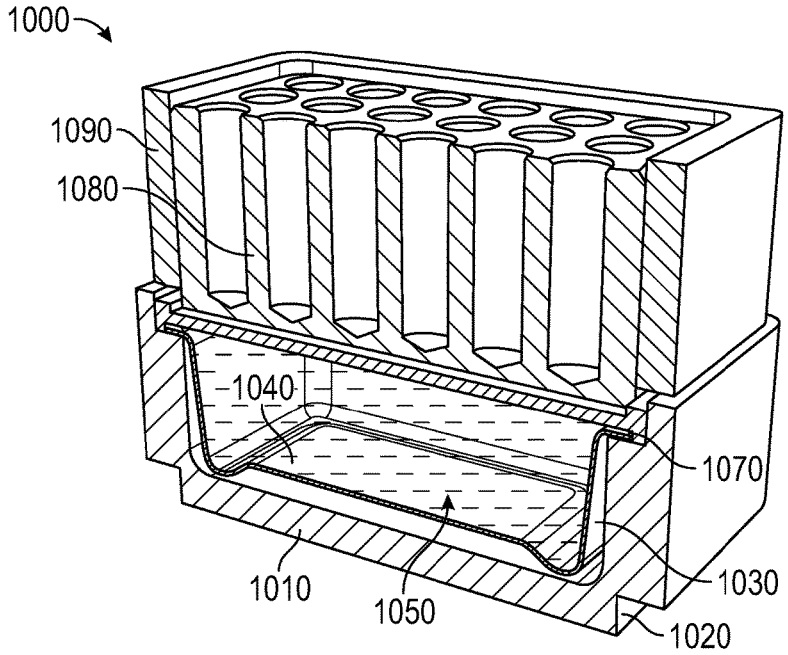
FIG. 10 shows a cross section view of a thermal sink cooling cartridge in accordance with a representative embodiment of the present invention.

FIG. 10 shows an embodiment the invention that is configured to interface with or compatibly mount to a work surface of a high-throughput automation robot. In particular, the width and length of the cartridge base are equal to the dimensions of a standard SBS plate, thereby enabling the cartridge to be used in place of a standard SBS plate. The embodiment shown comprises a foam insulation base 1010 with a base foundation 1020 of the SBS microplate dimensions (5.050 inches in length, 3.370 inches in width). The assembly 1000 can be placed directly into SBS microplate receivers to provide cooling for a variety of objects, including but not limited to microplates, vessel racks, thermally conductive adaptors, liquid dispensation troughs, and storage containers. The thermally conductive plate 1060 is bonded directly to a plastic inner vessel 1030 by an adhesive joint or sealant 1070. A recess 1040 is shown molded into the plastic inner vessel to allow for expansion of the aqueous contents 1050 upon solidification. A thermally conductive sample vessel rack 1080 is shown to illustrate one of the devices that can interface with the container surface 1060.

To reduce the rate of environmental thermal energy influx, the thermally conductive rack is surrounded by an insulating material 1090.

Figure 11:
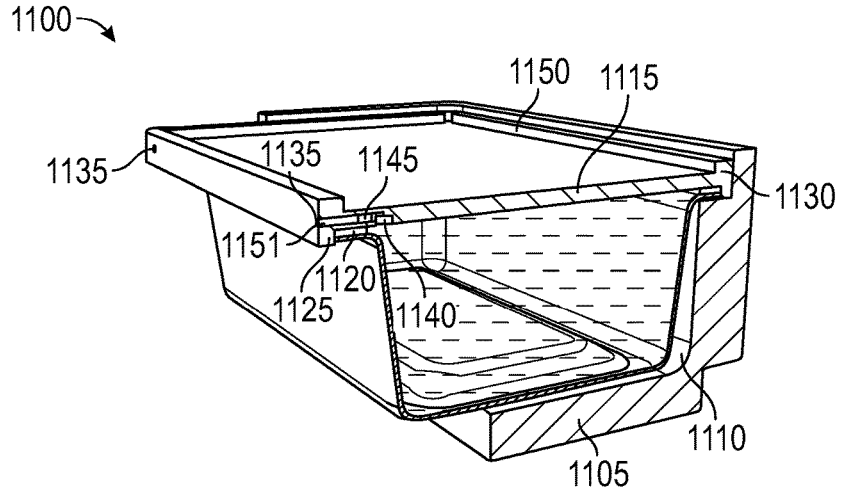
FIG. 11 shows added detail for the embodiment shown in FIG. 10, wherein the thermal sink cooling cartridge includes a port in accordance with a representative embodiment of the present invention.

Referring now to FIG. 11, a detailed view of the embodiment of FIG. 10 is shown. The insulation base 1105 is shown in double cross section to expose the side of the thermally conductive surface 1115. As the thickness of the adhesive bond 1120 is more difficult to control, the thermally conductive surface 1115 rests directly upon the base support 1130 through a flange extension 1125, thereby providing greater control of the overall height dimension of the surface to comply with the tolerance specification of the robotic mechanisms. As the temperature of the surface plate is maintained through the interaction of buoyant solidified aqueous phase change medium, it is important that the solid phase change medium float independent of the plastic container. As an alternative to nipples and ports through the plastic container 1110, liquid loading can be achieved through ports 1135 and passages 1140 introduced into the surface plate. After filling, the ports are plugged with a flexible bung 1145, and the remainder of the port is backfilled with a sealant 1151. Alternatively, the ports may be closed by plastic welding. The surface plate 1115 is shown with a machined recess 1150 that has the same dimensions as the foam base 1105 thereby forming a male-female vertical extension of the original receiver boundary on the robotic machine surface, allowing the same X and Y coordinates to be used for robotic component motions.

Some embodiments of the present invention comprise a method for assembling the thermal sink cooling cartridge of the present invention. Some methods include a first step of providing an expandable base container, as described herein. For some methods, and aqueous medium is placed into the interior of the expandable base container prior to sealing the base container with a thermoconductive cover. In some embodiments, the base container is joined and sealed, by means of a flange feature, to the upper thermoconductive cover by a flexible adhesive or sealant, including, but not limited to, a silicone-based adhesive. Prior to joining the base container and the thermoconductive cover, at least one of the base container and the thermoconductive cover is treated with oxygen, such as by heating the surface with an oxygen-rich flame. In other embodiments, the base container is joined by ultrasonic weld of the base container material to a fused deposit of the same or a similar material on the cover.

A method of assembly may further include a step for filling the interior of the expandable base container following assembly of the device. In these instances, a port is provided in at least one of the thermoconductive cover and the expandable base container, whereby the ports provide access to the interior of the base container. In some embodiments, and aqueous medium is inserted directly into the interior of the base container by pouring the aqueous medium through the port. In other embodiments, the assembled cartridge is submerged in a container of aqueous medium, wherein the aqueous medium displaces air within the interior of the cartridge via the port. Access or remaining air within the interior of the base container may be removed by applying a vacuum force to the cartridge via the port. The port is then sealed either temporarily or permanently, as may be desired. In some embodiments, it is desirable to provide further access to the interior of the cartridge, and therefore the port is temporarily sealed with a removable bung or plug.

Figure 12:
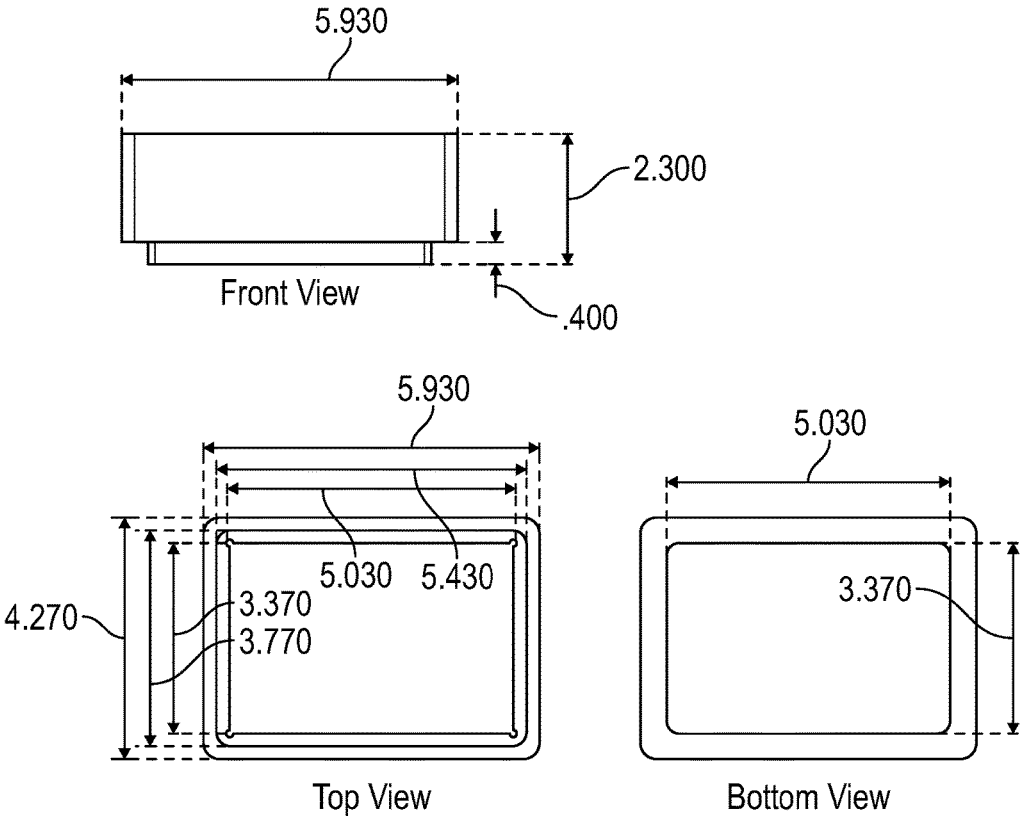
FIG. 12 shows the overall dimensions of the thermal sink cooling cartridge of the invention illustrated in FIGS. 10 and 11.

FIG. 12 shows the overall dimensions of the cartridge of the embodiments illustrated in FIGS. 10 and 11. The insulation housing dimensions are approximately 5.9 inches in length, 4.3 inches in width and 2.3 inches in height. The bottom view shows the adaptor base dimensions of 5.030 inches in length and 3.370 inches in width. The embodiment of the cartridge of the invention shown in FIGS. 10 through 12 is provided as an example of the cartridges of the invention that can be filled with phase change medium from the top of the cartridge, providing benefits described in Example 2, below.

Figure 13:
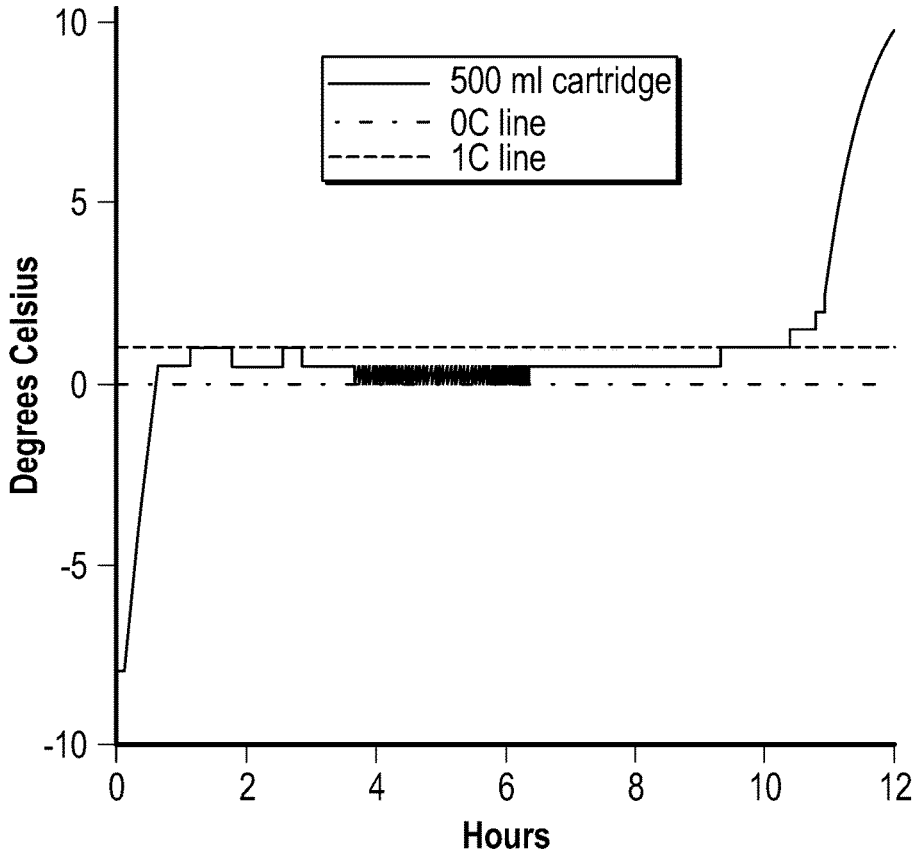
FIG. 13 shows a graph demonstrating the effectiveness of various representative embodiments of the present invention.

Referring now to FIG. 13, a graphical plot of the surface temperature of a cartridge of the design shown in FIGS. 10 through 12, generated as described in Example 2 below. The cartridge, without insulation, measured 5.9 inches length, 4.9 inches width, and 2.1 inches in height. The cartridge further included an internal capacity of approximately 500 ml.

Figure 14:
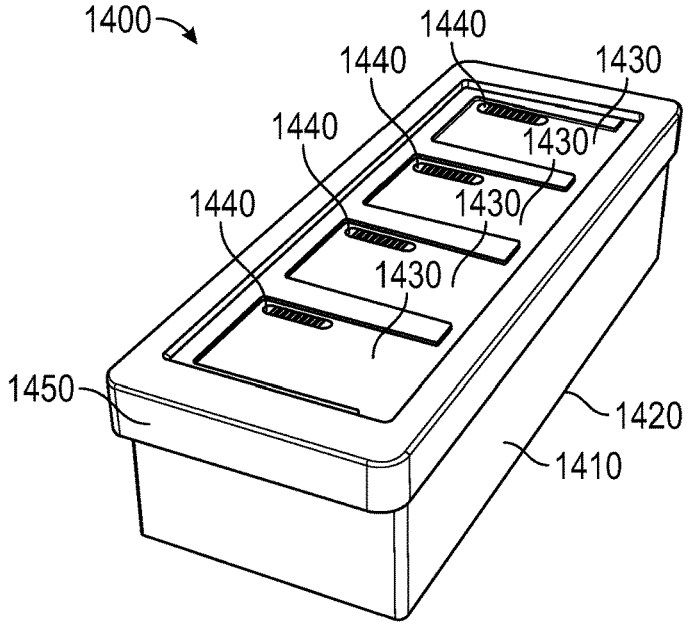
FIG. 14 shows a perspective view of a multiple bay thermal sink cooling cartridge having temperature sensitive strips in accordance with a representative embodiment of the present invention.
Figure 15:
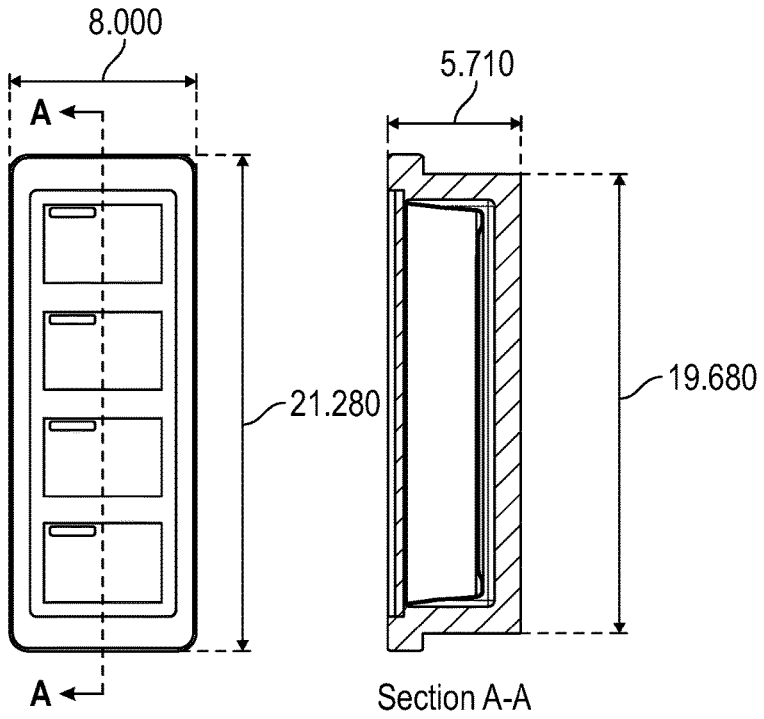
FIG. 15 shows the dimensions of the multiple bay thermal sink cooling cartridge displayed in FIG. 14.

FIG. 14 shows a multiple bay cartridge of the invention using the same internal construction as the cartridges shown in FIGS. 10 through 12. This embodiment is constructed with an exterior insulation of polyethylene foam 1410 that is laminated to a solid plastic base 1420 that comprises lateral groove recesses for insertion into a robot receiver tracks system such as that found on Hamilton STAR Liquid Handling Workstations. The foam insulation comprises foam handle extensions 1450 to facilitate transport. The cartridge surface comprises four SBS microplate dimension recesses 1430. The temperature of the SBS positions can be monitored by liquid crystal thermometer strips laminated in recesses machined into the plate surface to a depth such that the LCD temperature strip surface does not interfere with surface contact. Dimensions of the embodiment shown in FIG. 14 are provided in FIG. 15. In some embodiments, a cartridge is provided having an overall length of approximately 21.3 inches, with a width of 8 inches and a height of approximately 5.7 inches.

In some embodiments, the thermoconductive cover may contain contours, projections, recesses (as shown in FIGS. 11 and 14), grooves, alignment features, support features, and/or shapes for the purpose of interfacing with objects or a plurality of objects, including but not limited to sample vessels, thermally conductive sample vessel adaptors, thermometric probes, barcode or identification labels, magnetic materials, heat pipe adaptors, heat exchanger undercarriages, cartridge filling apparatus, and/or for secure nesting with other cartridges during storage, and/or for the purpose of breaking surface tension between the cartridge and external objects due to infiltration of atmospheric condensate into the interface. In other embodiments, the cover comprises wells, holes, or recesses for the purpose of directly interfacing with sample vessels including but not limited to test tubes, microfuge tubes, tube arrays, tube strips, culture plates, and single well and multi-well laboratory plates. The thermally conductive plate interface for external objects may be dedicated to a selected object or may comprise a universal adaptor station. A universal adaptor station may include, but not be limited to, a flat surface, a recess or boundary, detents, retainers, locks, pins, clips, clamps, springs or hold-downs for objects with an SBS standard microplate footprint or other footprint. In other embodiments, the thermally conductive surface may comprise a plurality of adaptor stations as with, for example, the embodiment described in FIGS. 14 and 15.

In some embodiments, the thermoconductive cover can contain embedded channels through which thermal energy can be introduced into or removed from the cartridge. For example, in some embodiments the channels are filled with thermoconductive materials that can extend beyond the limits of the cartridge to interface with external objects. Non-limiting examples of thermoconductive materials that can be used include copper, silver, aluminum, and heat tubes. Thus, in some embodiments the thermoconductive channels permit the use of the cartridge for applications where direct contact of the external object with the upper thermoconductive surface of the cartridge is not appropriate. Non-limiting examples of external objects include refrigeration systems, Peltier coolers, cold sinks, remote thermoconductive adaptors, and objects spatially restricted by functional limitations such as isolation chamber, robotic machines, electronic assemblies, semiconductor chips, heat exchangers, medical devices, and clean rooms.

In some embodiments, the cover has sealable ports by which the phase change material may be inserted into the cartridge cavity or internal space. In other embodiments the thermally conductive cover may have phase change material filling ports that contain self-sealing valves such as Schrader valves. In other embodiments, the base container has sealable ports by which the phase change material is inserted.

In some embodiments, the thermoconductive cover may further comprise embedded magnets for the purpose of temporarily mating the thermoconductive plate to external objects. The objects to be mated may include, but without limitation to, undercarriages of objects to be cooled, thermal conduits, thermally conductive adaptors.

In some embodiments, the base container further comprises tapered or flared walls such that the solid phase of the phase change material may release and float free of contact with the base container following the initial thawing of the outermost portion of the phase change material.

In some embodiments, the base container has an upper flange, ridge, or sleeve by which a sealed interface with the upper cover can be achieved. In some embodiments, the interface seal between the base container and the cover is achieved by an adhesive bond, as discussed previously.

Figure 16:
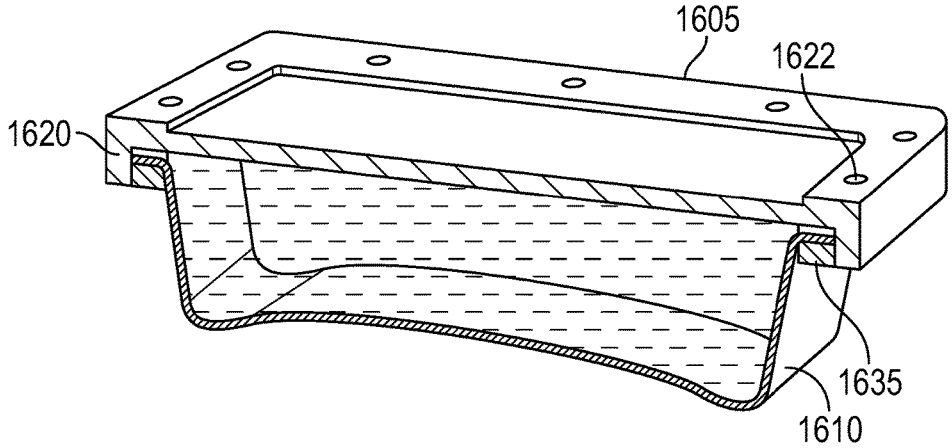
FIG. 16 shows a cross section view of a thermal sink cooling cartridge having a compressed gasket seal in accordance with a representative embodiment of the present invention.

Referring now to FIG. 16, in some embodiments a seal is achieved using an intermediate gasket 1620 which is compressed between the thermoconductive cover 1605 and a lip or flange of the expandable base container 1610. The compression is achieved via a rigid backing ring 1635 which is secured to cover 1605 via screws or bolts 1622. Alternatively, in some embodiments gasket 1620 is compressed between the two surfaces by a crimp edge or banding. In other embodiments, the seal is achieved by compressing an o-ring between the base container and the upper cover. Further, in some embodiments the seal is achieved using a compressed ridge that is a molded feature of the base container. Still further, in some embodiments two or more of these means for forming a seal are employed to construct a cartridge of the invention.

In some embodiments, gasket 1620 comprises a portion of expandable base container 1610. For example, in some embodiments base container 1610 comprises a flexible material, such as Santoprene™, which be compressed between thermoconductive cover 1605 and rigid backing ring 1635 to act as its own seal. In other embodiments, base container 1610 or thermoconductive cover 1605 comprise a composite material having an integrated surface layer which may be compressed to act as its own seal. Thus, gasket 1620 may include an independent component, or may include an integral part of base container 1610 or thermoconductive cover 1605.

In some embodiments, the base container is an injection-molded synthetic material. In other embodiments, the base container material is shaped by vacuum or pressure molding. Further, in some embodiments the base container is a flexible bag.

In some embodiments, the cartridge cavity is filled completely with an aqueous medium having a lower density in the solid phase such that the solid phase rises under buoyant forces to remain in constant contact with the underside of the upper thermoconductive cover. In some embodiments, the expandable base container is filled with an aqueous medium prior to sealing with the container with the thermoconductive cover. In other embodiments, a port is provided which provides access to the interior of the expandable base container. For these embodiments, the expandable base container is filled with the aqueous medium by submerging the cartridge into a pool or container of the aqueous medium. Remaining air within the cartridge may be removed by applying a vacuum line to the port, thereby drawing the remaining air from the interior of the base container.

In some embodiments, the cartridge comprises handles, finger grip recesses, and/or ridges to aid in transport. In various embodiments, the cartridge has one or more features that provide secure interface between other cartridges and/or between a cartridge and an external housing. Thus, the thermal sink cooling cartridge of the present invention may further include various features and surfaces to facilitate handling of the device. Referring back to FIG. 1, for example, the expandable base container 110 may include a contact surface 107 having a feature, a texture, a contour, and/or a shape to assist a user in handling and transporting the cartridge device.

In some embodiments, the invention provides a cartridge that is selectively inserted into an insulating housing. In some embodiments, all or part of the cartridge is permanently mated with a housing. Such permanent mating can be beneficial, for example, and without limitation for insulating the cartridge, protecting the cartridge from impact damage, and/or secondary containment of the cartridge contents should leakage occur. The thermal sink cooling cartridge of the present invention may further include various features and surfaces to accept or compatibly receive an external storage housing. For example, an external surface of the cooling cartridge may include a feature, a texture, a contour, and/or a shape which engages or interlocks with a feature, texture, contour, and/or shape of an interior surface of a storage housing. A storage housing may include a container comprising an insulating material, such as polyethylene foam, polypropylene foam, styrene foam, urethane foam, and evacuated containers. In some implementations, the storage housing comprising a shipping container.

In some embodiments, the insulation or storage housing directly contains the phase change material. In such an embodiment, the thermally conductive cover is bonded directly to the insulation material. Materials that may be used for such embodiments include but are not limited to closed-cell high density polyethylene foam. Cartridges constructed by this method may comprise undercut recesses on the underside of the insulation for the purpose of maintaining the overall exterior dimensions of the cartridge following the expansion of the phase change material.

In some embodiments, the base container comprises a flange that can be used for suspending the cartridge in an insulated housing. In other embodiments the cartridge thermoconductive cover comprises a flange extension by which the cartridge is suspended in the insulation housing. The flange extension may be manufactured to a high tolerance relative to the top surface of the cover, thereby making the height of the top surface independent of the thickness of the adhesive joint. Precision in the height dimension will be of value in applications wherein the overall height dimension is critical. Examples may include but not be limited to robotic applications and manually operated volumetric dispensation machines.

The cartridges of the invention may be made in any size and shape. The size, thickness, and overall dimensions of the cartridge selected for an application of interest are adjusted to provide the optimal, most functional, cartridge for that application. For illustration and not limitation, one can, for example, alter the internal volume of the cartridge to provide a required cooling duration (smaller volumes providing shorter duration). Illustrative volumes may be, for example, in the range of microliters to milliliters to liters and even thousands of liters.

In some embodiments, the thermoconductive cover is manufactured by machining from billet material. In other embodiments, the cover is constructed from rolled sheet material. In other embodiments, the cover is constructed from cast or sintered metals.

In some embodiments, the insulation housing may comprise permanent or temporary extensions or features for mating with external objects. The extensions may include, but not be limited to, flanges, rails, baseplates, bearings, floats, cushions, bumpers, slides, tracks, mounts, suspensions, shock absorbers, skids, cradles and frames. The external objects to which the insulation housing may mate with include, but are not limited to robotic or manual machine platens, mounting plates, racks, floors, rails, tracks, flanges, rails, baseplates, bearings, floats, cushions, bumpers, slides, tracks, mounts, suspensions, shock absorbers, skids, cradles and frames, and freezer racks, stations, compartments and drawers.

In some embodiments, the cartridge may be used for warming purposes by increasing the temperature of the cartridge contents and using the cartridge as a thermal mass for transient temperature range management. In other embodiments, the cartridge may be used as a passive thermal buffer to counter transient temperature changes.

In some embodiments, the cartridge may be use to control the temperature of objects during shipment, while in other embodiments, the cartridge may be use to control the temperature of food.

Thus, the invention has a wide variety of aspects, embodiments, and applications, as reflected in the following examples and claims.

Example 1. Cartridge of the Invention Provides Superior Cooling

An aqueous sample was placed into a microplate well of a microtiter plate, after which the microplate was placed onto a room temperature thermoconductive adaptor of the type shown in FIG. 3, as item 330. The microplate and adaptor were then placed in contact with the upper surface of either a cartridge of the construction shown in FIGS. 1 and 2 with a capacity of 225 grams of water (black trace in FIG. 4), or a gel based cooling cartridge (consisting of 236 grams of an aqueous gel material contained in a thin plastic bag and surrounded by a 0.1 inch thick aluminum sheet with the exception of the end surfaces, i.e. the gel cooling cartridge device marketed by BioCision, LLC, under catalog number BCS-152) (grey traces in FIG. 4). All cartridges were previously frozen overnight to −18 degrees Celsius. The temperature of the sample was monitored with the use of a thermocouple probe, and the measurements were plotted as shown in FIG. 4. The temperature traces from the gel cartridges show a linear increase in temperature from 0.5 hours to 6.5 hours due to the increasing thickness of the boundary of thawed gel material that surrounds the still-frozen core and imposes an increasing resistance to the transfer of thermal energy to the frozen core. The continuously rising sample temperature places a significant portion of the temperature profile above the desired temperature band of 0° Celsius to 4° Celsius. The temperature profile of the cartridge of this invention, under identical conditions, remains between 0.5° Celsius and 2.5° Celsius over the same interval as the solid phase of the water is held in direct contact with the thermoconductive upper plate of the cartridge without the formation of an insulating layer of thawed phase change material. The sample temperature only begins to rise when the cartridge is exhausted at approximately 6.5 hours.

Example 2. Alternate Cartridge of the Invention Provides Superior Cooling

A cartridge of the invention as described in FIGS. 10 through 12 was used to generate a graphical plot of the surface temperature of the cartridge after freezing. The graph, shown in FIG. 13, demonstrates the benefit of the top plate port filling system used to generate the cartridge. The surface temperature of the top plate measured consistently between 0 degrees Celsius and 1 degree Celsius for approximately 10 hours. As the solid ice did not have to melt free of the interior plastic filling port nipple, as was the case with the cartridge used to obtain the data for FIG. 4, the solid ice became free from the plastic container early in the test. As a result the temperature profile is very flat.

The invention claimed is:

1. A thermal sink cooling cartridge, comprising:

a base container having a bottom surface, an opening, and exterior side walls extending between the bottom surface and the opening and tapering outwardly from the bottom surface to the opening, said bottom surface and exterior side walls forming an outermost exterior surface of the fully-assembled thermal sink cooling cartridge, said bottom surface further comprising an expansion panel configured to expand in response to an increased pressure within the base container to maintain overall exterior dimensions of the thermal sink cooling cartridge in use;

a thermoconductive cover having an undersurface coupled to and enclosing the opening of the base container and adapted to provide a thermally conductive interface between the thermal sink cooling cartridge and an external object placed on the thermoconductive cover in direct contact and to be maintained at a desired cooled temperature;

a fluid tight seal interposed between the opening and the thermoconductive cover; and a phase change material comprising an aqueous material having a liquid phase and a solid phase, the solid phase being buoyant within the liquid phase, said phase change material entirely filling the base container in both the liquid and solid phases such that the phase change material is in continuous contact with the undersurface of the thermoconductive cover, wherein solidification of the aqueous medium induces the increased pressure within the base container.

2. The cartridge of claim 1, further comprising a molded feature in contact with the phase change material, the cartridge comprising a volume which reduces in response to the increased pressure to allow for expansion of the phase change material.

3. The cartridge of claim 1, wherein the thermoconductive cover is composed of a thermoconductive material selected from the group consisting of aluminum, copper, silver, an aluminum alloy, a copper alloy, a silver alloy, a titanium alloy, stainless steel, and a magnesium alloy.

4. The cartridge of claim 1, further comprising a temperature sensitive strip coupled to an outer surface of the thermoconductive cover.

5. The cartridge of claim 1, further comprising a contact surface to facilitate handling of the cartridge, wherein the contact surface comprises a portion of at least one of the expandable base container and the thermoconductive cover.

6. The cartridge of claim 1, wherein the phase change material is selected from the group consisting of water, purified water, and water containing an additive selected from the group consisting of glycerol, a salt, polyethylene glycol, an alcohol, a simple sugar, a complex sugar, and a starch.

7. The cartridge of claim 1, wherein the fluid tight seal is selected from a group consisting of an adhesive, a silicone-based adhesive, a compressed gasket, an o-ring, a compression band, a clamp, a crimped seal, a fusion weld, and a rim channel molded into a base portion of the expandable base container.

8. The cartridge of claim 1, further comprising at least one of a ridge, a groove, a peg, a hole, a texture, a feature, a protrusion, an encasement, and an indent to accommodate or receive an external object.

9. The cartridge of claim 8, wherein the external object is at least one of a biological sample, an organic material, an inorganic material, a food, dry ice, an electronic component, an automated machine, a stand, a refrigeration device, a computer chip, a sample tray, a sample tube, a container, an adapter for a container, and a sample rack.

10. The cartridge of claim 1, wherein the cartridge further comprises an external surface for compatibly receiving a storage housing.

11. The cartridge of claim 10, wherein the storage housing is composed of an insulating material selected from the group consisting of polyethylene foam, polypropylene foam, styrene foam, urethane foam, and evacuated containers.

12. The cartridge of claim 1, further comprising one or more ports that are used to access an interior of the expandable base container to add, modify, or replace said phase change material.

13. The cartridge of claim 1, wherein the expandable base container is composed of a material selected from the group consisting of polyethylene and polypropylene polymers.

14. The cartridge of claim 10 wherein the storage housing is a shipping container.

15. The cartridge of claim 1, wherein at least one magnet is attached to the thermally conductive cover.

16. The cartridge of claim 1, wherein the phase change material comprises an antimicrobial material.

17. The cartridge of claim 2, wherein the molded feature is a compressible element.

18. A thermal sink cooling cartridge, comprising:

a base container having a bottom surface, an opening, and exterior side walls extending between the bottom surface and the opening, said bottom surface and exterior side walls forming an outermost exterior surface of the fully-assembled thermal sink cooling cartridge, the base container further having an internal volume, and at least one of the bottom surface and the exterior side walls being configured to flex outwardly to provide an increased internal volume of the base container;

a thermoconductive cover having an undersurface and enclosing the opening of the expandable base container and adapted to provide a thermally conductive interface between the thermal sink cooling cartridge and an external object placed on the thermoconductive cover in direct contact and to be maintained at a desired cooled temperature;

a fluid tight seal interposed between the opening and the thermoconductive cover; and a phase change material having a liquid phase and a solid phase, said phase change material entirely filling the internal and increased internal volumes in both the liquid and solid phases, respectively, such that said phase change material is in continuous contact with the undersurface of the thermoconductive cover, the liquid phase comprising a first volume equal to the internal volume, and the solid phase comprising a second volume that is equal to the increased internal volume.

* * * * *